US006507238B1

(12) United States Patent
Yang

(10) Patent No.: US 6,507,238 B1
(45) Date of Patent: Jan. 14, 2003

(54) TEMPERATURE-DEPENDENT REFERENCE GENERATOR

(75) Inventor: Jungwook Yang, West Nyack, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/888,106

(22) Filed: Jun. 22, 2001

(51) Int. Cl.[7] ..... G05F 1/10
(52) U.S. Cl. ..... 327/540
(58) Field of Search ..... 327/530, 534, 327/535, 537, 538, 539, 540, 541, 542, 543

(56) References Cited

U.S. PATENT DOCUMENTS 5,796,294 A * 8/1998 Perry ..... 327/513
6,037,833 A * 3/2000 Ang ..... 323/313
6,160,393 A 12/2000 Ahn et al. ..... 323/315
6,346,848 B1 * 2/2002 Shkap ..... 323/312

* cited by examiner

*Primary Examiner*—Jeffrey Zweizig
(74) *Attorney, Agent, or Firm*—Paul J. Otterstedt; Ryan, Mason & Lewis, LLP

(57) ABSTRACT

A reference generator having a temperature-dependent output variation that is greater than an absolute temperature variation includes a first source and a second source, the first source generating a proportional to absolute temperature (PTAT) output. The second source generates an output having a temperature coefficient less than or equal to zero. The reference generator further includes a subtraction circuit coupled to the first and second sources, the subtraction circuit operatively subtracting the output of the second source from the PTAT output and generating an offset output, the offset output having a variation greater than an absolute temperature variation. Using the reference generator described herein in accordance with the invention, circuits having a relatively high temperature dependency can be easily compensated. Moreover, the reference generator is suitable for temperature sensing with large temperature dependency without requiring a high supply voltage.

13 Claims, 4 Drawing Sheets

200
VDD
vbb
202
204
206
M1
M2
M3
M4
S
G
D
Q1
Q2
Q3
Q4
Q5
Q6
Q7
C
B
E
R1
R2
R3
R4
210
208
214
216
218
220
212
I0
I3
$I_{PTAT}$
$I_{CPTAT}$
$I_{OPTAT}$
$n*I_{PTAT}$
$k*I_{PTAT}$
$\Delta V_{BE}$
+
-

400
VDD
202
M1
M2
M3
M4
S
G
D
210
$I_{PTAT}$
$I_{PTAT}$
Q1
Q2
B
C
E
R1
402
I3
218
Q4
$I_{CPTAT}$
214
216
Q5
R2
I0
206
$n*I_{PTAT}$
212
Q6
Q7
R3
$I_{OPTAT}$
R4
vbb

TEMPERATURE-DEPENDENT REFERENCE GENERATOR

FIELD OF THE INVENTION

The present invention relates generally to reference generator circuits, and more particularly relates to a temperature-dependent reference generator suitable for large temperature-variation applications.

BACKGROUND OF THE INVENTION

In the design of various analog and digital circuits, it is often necessary to establish a temperature-independent bias reference within the circuit. This stable bias reference can be either a voltage or a current, although voltage references are most often employed because they are generally easier to interface with other functional sub-circuits. In the case of a voltage reference, the primary emphasis is not on low output impedance, as it is in the case of a voltage source, but rather emphasis is on the temperature stability of the voltage level.

The basic principle of temperature compensation typically involves the use of two temperature-dependent sources, each source having a predictable and opposite polarity temperature drift. One or both sources are then scaled by a temperature-independent scale factor such that when the two temperature-dependent sources are added together, the effects of the two opposite polarity temperature drifts are made to substantially cancel. The resulting reference source will thus ideally exhibit a nominally zero temperature coefficient (TC) voltage or current level.

Current source circuits having an output which is proportional to absolute temperature ($I_{PTAT}$) are well known and widely used for temperature compensation and temperature sensing to obtain either temperature-dependent or temperature-independent biasing. However, since $I_{PTAT}$ is only proportional to absolute temperature, the maximum current variation that can be generated at any given temperature T is $\Delta T/T_{nom}$, where $\Delta T$ is the temperature range of operation, in degrees Kelvin (K), and $T_{nom}$ is the nominal operating temperature in degrees K. Thus, for example, at 300 degrees K, an $I_{PTAT}$ Current source can have a maximum current variation of 33% in a range from 300 degrees K to 400 degrees K. In many temperature compensation and temperature sensing applications, however, a current variation greater than the absolute temperature variation is required.

Accordingly, there exists a need for a reference source capable of providing an output having a temperature variation greater than the absolute temperature variation.

SUMMARY OF THE INVENTION

The present invention provides a temperature-dependent reference generator having an output variation greater than an absolute temperature variation. Using the reference generator described herein in accordance with the present invention, circuits having a relatively high temperature dependency can be easily compensated. Moreover, the reference generator is suitable for temperature sensing with large temperature dependency without requiring a high supply voltage.

In accordance with one aspect of the invention, a reference generator having a temperature-dependent output variation that is greater than an absolute temperature variation includes a first source and a second source, the first source generating an output proportional to absolute temperature (PTAT). The second source generates an output having a temperature coefficient less than or equal to zero. The reference generator further includes a subtraction circuit coupled to the first and second sources, the subtraction circuit subtracting the output of the second source from the PTAT output and generating the temperature-dependent output having a variation greater than an absolute temperature variation.

In accordance with another aspect of the invention, a method of generating a temperature-dependent reference output having a variation greater than an absolute temperature variation comprises the steps of generating a first output having a variation that is proportional to absolute temperature (PTAT) and generating a second output, the second output having a temperature coefficient that is less than or equal to zero. The method further includes the step of subtracting the second output from the first output to generate the temperature-dependent reference output having a variation greater than an absolute temperature variation.

These and other objects, features and advantages of the present invention will become apparent from the following detailed description of illustrative embodiments thereof, which is to be read in connection with the accompanying drawings.

DETAILED DESCRIPTION OF PREFERRED EMBODIMENTS

The present invention will be explained below in the context of an illustrative temperature-dependent current reference circuit. However, it should be understood that the present invention is not limited to any particular type of reference circuit. Rather, the invention is more generally applicable to any suitable reference circuit in which it is desirable to generate an output having a variation greater than an absolute temperature variation. Moreover, although implementations of the present invention are described herein using npn bipolar junction transistor (BJT) devices and p-type metal oxide semiconductor (MOS) devices, it is to be appreciated that the present invention is not limited to such devices, and that other suitable devices, such as, but not limited to, pnp BJT devices and/or n-type MOS devices, may be similarly employed, with or without modifications to the circuit, as understood by those skilled in the art.

A current proportional to absolute temperature, $I_{PTAT}$, may be expressed as $I_{PTAT}$=aT, where a represents a temperature coefficient and T represents absolute temperature in degrees Kelvin (° K.). A change in current proportional to absolute temperature, $\Delta I_{PTAT}$, with respect to a given nominal current, $I_{nom}$, may be expressed as a ratio $$\frac{\Delta I_{PTAT}}{I_{nom}} = \frac{\Delta T}{T_{nom}},$$

where ΔT represents an operational temperature range (in ° K.) and $T_{nom}$ represents nominal temperature (in ° K.). In order to obtain a current variation ($\Delta I/I_{nom}$) which is greater than the absolute temperature variation ($\Delta T/T_{nom}$), a current source may be formed, in accordance with the invention, which includes an offset temperature coefficient to generate an output current $I_{OUT}=I_{PTAT}-I_0$, where $I_0$ is a current having a temperature coefficient less than or equal to zero.

Figure 1A:
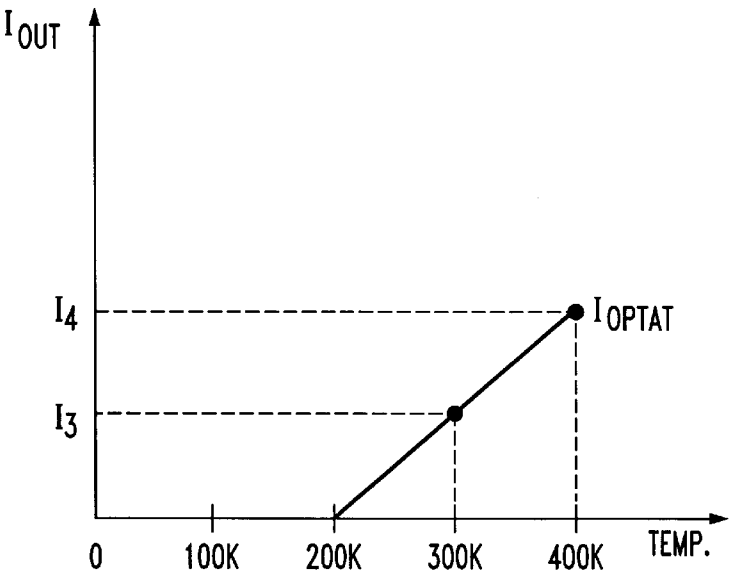
FIG. 1A is a graphical representation illustrating a current proportional to absolute temperature (PTAT) and a temperature-independent current, in accordance with one aspect of the invention.
Figure 1B:
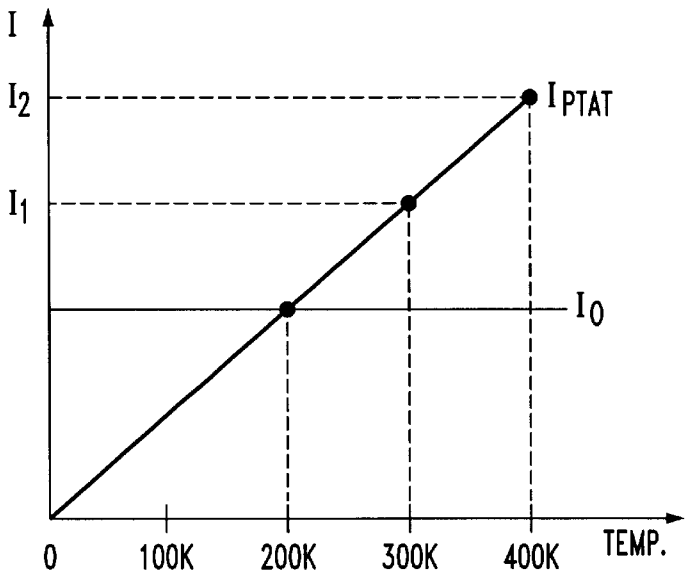
FIG. 1B is a graphical representation illustrating an offset PTAT current corresponding to a subtraction of the temperature-independent current from the PTAT current in FIG. 1A, in accordance with the present invention.

FIG. 1A depicts a graph of current versus temperature, in degrees K, illustrating a current proportional to absolute temperature ($I_{PTAT}$) superimposed on the same axis as a temperature-independent constant current having a value $I_0$. As shown in FIG. 1A, by way of example only, current $I_{PTAT}$ has a value of $I_1$ at 300° K. and $I_2$ at 400° K. Let $\Delta I_{PTAT}=I_2-I_1$ represent the absolute value of current variation over the temperature range of 300° K. to 400° K. In the example of FIG. 1A, the current value of $I_{PTAT}$ is equal to $I_0$ at 200° K. With reference now to FIG. 1B, an offset current proportional to absolute temperature, $I_{OPTAT}$, is graphically displayed in terms of output current $I_{OUT}$ value verses temperature, where $I_{OUT}=I_{PTAT}-I_0$, as previously stated. As shown in FIG. 1B, by way of example only, current $I_{OPTAT}$ has a value of zero (which corresponds to $I_{PTAT}-I_0$) at 200° K., $I_3$ at 300° K. and $I_4$ at 400° K., where $I_3=I_1-I_0$ and $I_4=I_2-I_0$. It can be easily shown that although the relative quantities $|I_2-I_1|$ and $|I_4-I_3|$ are equal, the current variation ($\Delta I/I_{nom}$) of $I_{OPTAT}$ will be greater than the current variation of $I_{PTAT}$ since, by definition, the value of $I_{OPTAT}$ will be less than the value of $I_{PTAT}$ for any given temperature. For example, with reference to FIG. 1A, the current variation of $I_{PTAT}$ in the temperature range of 300° K. to 400° K. will only be 33 percent. By contrast, the current variation of $I_{OPTAT}$ in the same temperature range will be approximately 100 percent, depending upon the value of the constant current $I_0$.

Figure 2:
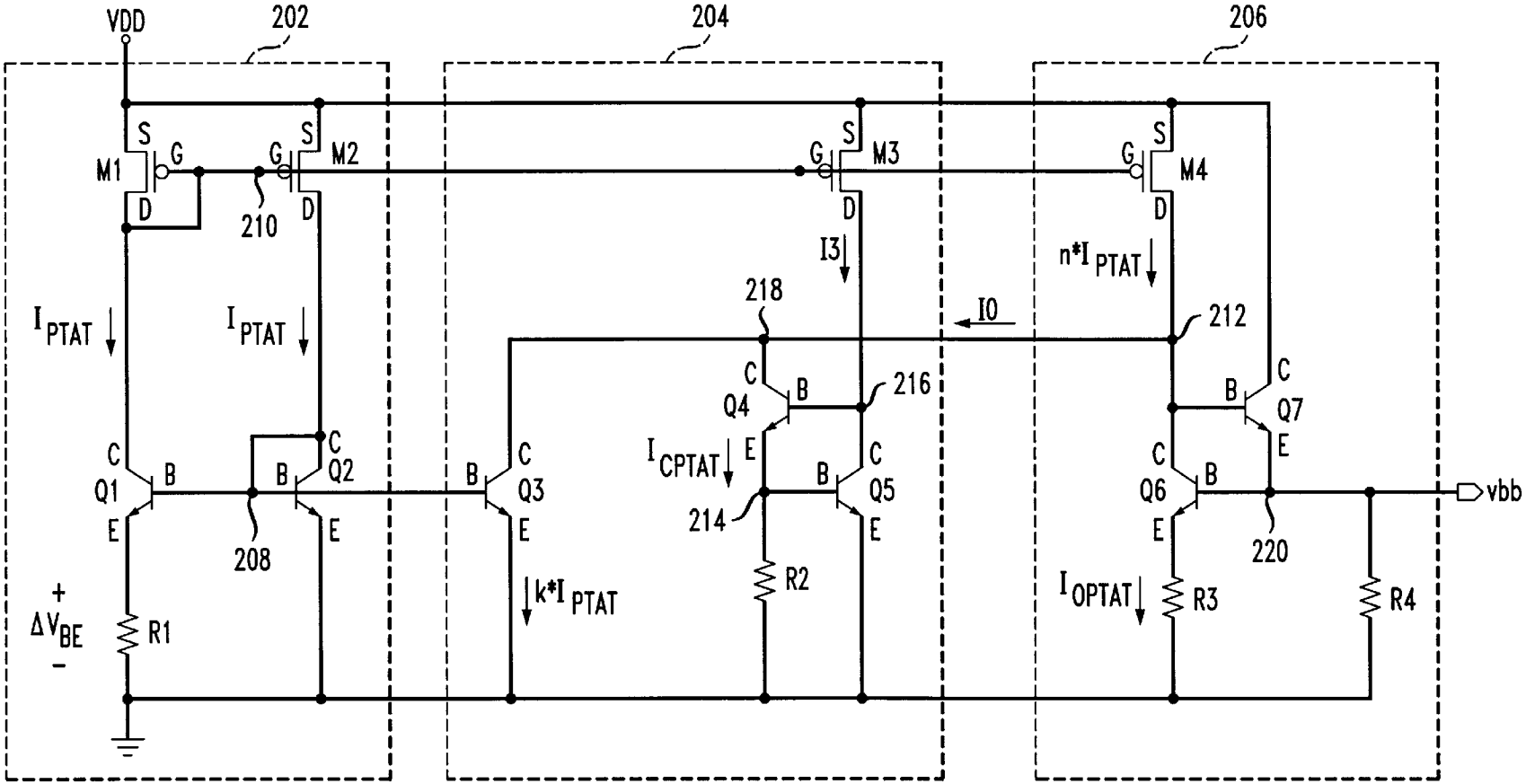
FIG. 2 is a schematic diagram illustrating a temperature-dependent reference source, formed in accordance with one aspect of the present invention.

FIG. 2 illustrates a circuit for implementing a temperature-dependent reference having an output variation greater than the absolute temperature variation, formed in accordance with one aspect of the invention. The illustrative reference circuit 200 includes a proportional to absolute temperature (PTAT) current source 202, a constant current source 204 and a subtraction circuit 206 operatively coupled to the PTAT current source 202 and the constant current source 204 for generating the temperature-dependent output current $I_{OPTAT}$.

The PTAT current source 202 may be implemented as at least a portion of a bandgap reference circuit. The principle of the bandgap reference is well known and will therefore only be discussed briefly herein. A core of the bandgap reference circuit relies on two BJT transistors Q1 and Q2 (or, alternatively, two groups of transistors) operating at different current densities. This difference in current density will cause a difference between a base-emitter voltage ($V_{BE}$) of the two transistors Q1, Q2. Transistor Q2 is preferably connected in a diode configuration (i.e., base and collector terminals coupled together), and the base terminals of each transistor Q1, Q2 are connected together at node 208. An emitter terminal of transistor Q2 is connected to a negative voltage supply, which may be ground. An emitter terminal of transistor Q1 is coupled to ground through a series-connected resistor R1.

A collector current flowing through transistor Q1 is ideally made equal to a collector current flowing through transistor Q2 by way of, for example, a simple current mirror comprising a pair of p-type metal-oxide-semiconductor (MOS) devices M1 and M2 operatively coupled to transistors Q1 and Q2, respectively, each transistor M1, M2 having a predetermined width-to-length (W/L) ratio associated therewith. Other suitable current mirror or biasing arrangements are similarly contemplated by the present invention, as will be understood by those skilled in the art. In the illustrative reference circuit 200, the current mirror includes a diode-configured (i.e., gate and drain terminals coupled together) transistor M1 which is connected such that a gate terminal of transistor M1 is coupled to a gate terminal of transistor M2 at node 210 and a source terminal of each transistor M1, M2 is coupled to a positive voltage supply, which may be VDD. Drain terminals of each transistor M1, M2 are coupled to collector terminals of corresponding transistors Q1, Q2, respectively.

As previously stated, the collector current flowing through transistor Q1 is ideally equal to the collector current flowing through transistor Q2, which is facilitated by making the W/L ratios of transistors M1 and M2 identical. In order to generate a difference in base-emitter voltage ($\Delta V_{BE}$) between the two transistors Q1, Q2, the current density of transistor Q1 is preferably made to be greater than the current density of transistor Q2. Since the two transistors Q1, Q2 will have equal collector currents, a voltage $\Delta V_{BE}$ (corresponding to the difference between the base-emitter voltages of transistors Q2 and Q1) will be dropped across resistor R1. The difference in the base-emitter voltages of the two transistor Q1, Q2 is related directly to a ratio of emitter areas A1 and A2 of the transistors Q1 and Q2, respectively, and can be calculated (at least to a first order) by the following equations:

$$\Delta V_{BE} = V_{BE,Q2} - V_{BE,Q1} = V_T \cdot \ln\left[\frac{I_{C2}}{I_{C1}} \cdot \frac{A1}{A2}\right] \tag{1}$$

$$\Delta V_{BE} = \frac{kT}{q} \cdot \ln\left[\frac{A1}{A2}\right] \tag{2}$$

where $V_T$, which is proportional to temperature, is often referred to as thermal voltage and is approximately 26 millivolts (mV) at 25 degrees Celsius (C), k is Boltzman's constant (approximately $1.381\times10^{-23}$ Joules/degree Kelvin), T is temperature in degrees Kelvin (° K.), and q is electron charge (approximately $1.6\times10^{-19}$ coulomb). By selecting an appropriate value for resistor R1, a current proportional to absolute temperature (PTAT) $I_{PTAT}$ is generated which biases transistor Q2, such that $$Iptat = \frac{kT}{q} \cdot \frac{\ln\left[\frac{A1}{A2}\right]}{R1} \tag{3}$$

By way of example only, if transistor Q1 is made to have an emitter area ten times larger than that of transistor Q2, a voltage $\Delta V_{BE}$ of approximately 60 mV will appear across resistor R1. Using equation (3) above, the current $I_{PTAT}$ flowing through transistor Q2, and likewise through transistors M1 and M2 accordingly, can be determined for a selected bias resistor R1.

As observed in equation (1) above, rather than scaling the emitter areas A1, A2 of transistors Q1, Q2, respectively, as previously described, the emitter areas of the these two transistors can be made substantially equal to each other and instead the collector currents $I_{C1}$, $I_{C2}$ of the two transistors Q1, Q2, respectively, may be scaled accordingly, such as by an appropriate selection of W/L ratios for the two transistors M1, M2. For example, by making the W/L ratio of transistor M2 ten times larger than transistor M1, the drain current of transistor M2 (which is equal to the collector current of transistor Q2) will be ten times larger than the drain current of transistor M1 (which is substantially equal to the collector current of transistor Q1) to provide a voltage drop $\Delta V_{BE}$ across resistor R1 consistent with that described above (i.e., about 60 mV).

With continued reference to FIG. 2, the illustrative temperature-dependent reference circuit 200 includes the constant current source 204 which operatively generates a constant output current $I_0$ that is substantially independent of temperature. In accordance with one aspect of the invention, the temperature-independent current $I_0$ is preferably generated by summing a weighted portion of the PTAT current generated by PTAT current source 202, which has a predictable positive temperature coefficient, with a matching current having an equally predictable but opposite (i.e., complinentary-PTAT) temperature coefficient, whereby the resulting current will exhibit a temperature coefficient that is substantially zero.

As understood by those skilled in the art, a base-emitter voltage $V_{BE}$ of a BJT device has a well-defined temperature coefficient (TC) of approximately −2 mV/degree Celsius (° C.). This voltage is preferably generated by a BJT transistor Q5 which, in the illustrative constant current source 204, has an emitter terminal connected to ground. A p-type MOS transistor M3 is coupled to transistor M1 in a mirror arrangement, with a source terminal of transistor M3 connected to the positive supply VDD and a gate terminal of transistor M3 coupled to the gate terminal of transistor M1, whereby a current I3 generated by transistor M3 is a scaled version of the PTAT current generated by the PTAT current source 202, e.g., $I3=m\cdot I_{PTAT}$. The scaling factor m between the current $I_{PTAT}$ and the current I3 is determined primarily by the W/L ratios of the two transistors M1, M3, respectively (i.e., $$\left(\text{i.e., } m = \frac{(W/L)_{M3}}{(W/L)_{M1}}\right).$$

A drain terminal of transistor M3 is coupled to a collector terminal of transistor Q5 such that the mirrored current I3 from transistor M3 is preferably used to bias transistor Q5 to a predetermined operating point.

A resistor R2 connected across the base and emitter terminals of transistor Q5 operatively converts the base-emitter voltage of transistor Q5 ($V_{BE,Q5}$) to a complimentary-PTAT current $I_{CPTAT}$ having a predefined negative temperature coefficient, whereby $Icptat=V_{BE,Q5}/R2$ (assuming the base current of transistor Q5 is negligible). This current $I_{CPTAT}$ is preferably passed through a transistor Q4, which has an emitter terminal connected to the junction of the base terminal of transistor Q5 and resistor R2 at node 214 and a base terminal connected to the junction of the collector terminal of transistor Q5 and the drain terminal of transistor M3 at node 216.

A scaled version of the PTAT current is preferably provided to the constant current source 204 by way transistor Q3 which is operatively coupled to transistor Q2 in a mirror arrangement. Specifically, an emitter terminal of transistor Q3 is connected to ground and a base terminal of transistor Q3 is connected to the base terminal of transistor Q2 at node 208. Preferably, the emitter area of transistor Q3 is k times the size of the emitter area of transistor Q2. Thus, transistor Q3 will generate a PTAT current that is k times the value of $I_{PTAT}$, i.e., $k\cdot I_{PTAT}$, where the scale factor k is a number greater than zero. A collector terminal of transistor Q3 is coupled to a collector terminal of transistor Q4 at node 218, whereby the current $k\cdot I_{PTAT}$ is operatively summed with the current $I_{CPTAT}$ to generate the output current $I_0$. The scale factor k and resistor R2 are preferably selected so as to make the two currents $k\cdot I_{PTAT}$ and $I_{CPTAT}$, which have opposite polarity temperature coefficients, substantially equal to each other. In this manner, the temperature coefficient of the resulting output current $I_0$ will be substantially zero, as previously stated.

As discussed above, in order to generate a current having a variation greater than the absolute temperature variation, a constant temperature-independent current is preferably subtracted from a PTAT current, in accordance with the invention. These two currents are generated by the PTAT current source 202 and the constant current source 204, respectively, as previously described. In order to perform the subtraction operation, subtraction circuit 206 is included in the illustrative reference circuit 200.

With continued reference to FIG. 2, the subtraction circuit 206 preferably includes a p-type MOS transistor M4 which is coupled to transistor M1 in a current mirror arrangement. Specifically, a source terminal of transistor M4 is connected to the positive supply VDD and a gate terminal of transistor M4 is coupled to the gate terminal of transistor M1 at node 210. The PTAT current generated by transistor M4 is designed to be larger than the constant temperature-independent current $I_0$ from constant current source 204 in at least a predetermined temperature range of interest. Consequently, the current $I_{PTAT}$ mirrored from PTAT current source 202 is operatively weighted by an appropriate scale factor n. The scale factor n is selected by sizing the W/L ratios of the two transistors M1 and M4, such that n=

$$n = \frac{(W/L)_{M4}}{(W/L)_{M1}}.$$

The current generated by transistor M4 will then be $n\cdot I_{PTAT}$.

A drain terminal of transistor M4 is coupled to the collector terminal of transistor Q4 to form a subtraction node at 212. A current sink comprising BJT transistors Q6 and Q7 is operatively coupled to the subtraction node 212 to provide a return path for a resulting current $I_{OPTAT}$ which is an offset version of the PTAT current. Specifically, a collector terminal of transistor Q6 and a base terminal of transistor Q7 are connected to subtraction node 212, a collector terminal of transistor Q7 is connected to the positive supply VDD, and an emitter terminal of transistor Q7 is connected to a base terminal of transistor Q6 to form an output node 220. An emitter terminal of transistor Q6 is coupled to ground through a series-connected resistor R3. A resistor R4 is connected between output node 220 and ground and provides a return current path of the emitter current flowing from transistor Q7 in the event that output node vbb remains unloaded.

Since the PTAT current $n\cdot I_{PTAT}$ flows into subtraction node 212 and constant current $I_0$, which is less than $n\cdot I_{PTAT}$, flows out of node 212, the resulting offset current $I_{OPTAT}$ flowing into transistor Q6, and thus through resistor R3, by definition, will be $I_{OPTAT}=n \cdot I_{PTAT}-I_0$, which, as previously discussed, exhibits a current variation over a given temperature range that is greater than the absolute temperature variation (see e.g., FIG. 1B). This current $I_{OPTAT}$ can be converted into a voltage vbb at output node 220 which will be the sum of the base-emitter voltage of transistor Q6 and the voltage drop across resistor R3. Thus, output voltage vbb=$V_{BE,Q6}$+(loptat·R3). The current $I_{OPTAT}$ may be mirrored by presenting voltage vbb to a similar current source circuit, as will be appreciated by those skilled in the art.

Figure 3B:
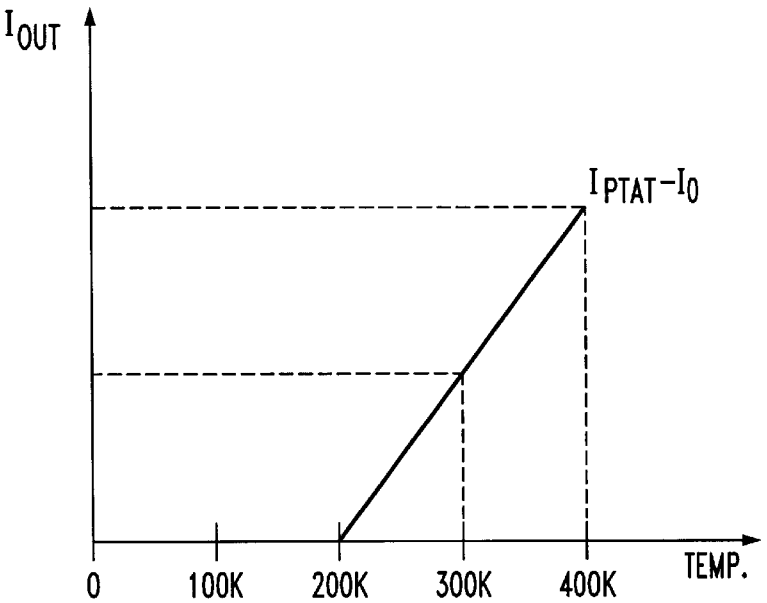
FIG. 3B is a graphical representation illustrating an offset PTAT current corresponding to a subtraction of the negative temperature coefficient current from the PTAT current in FIG. 3A, in accordance with the present invention.
Figure 3A:
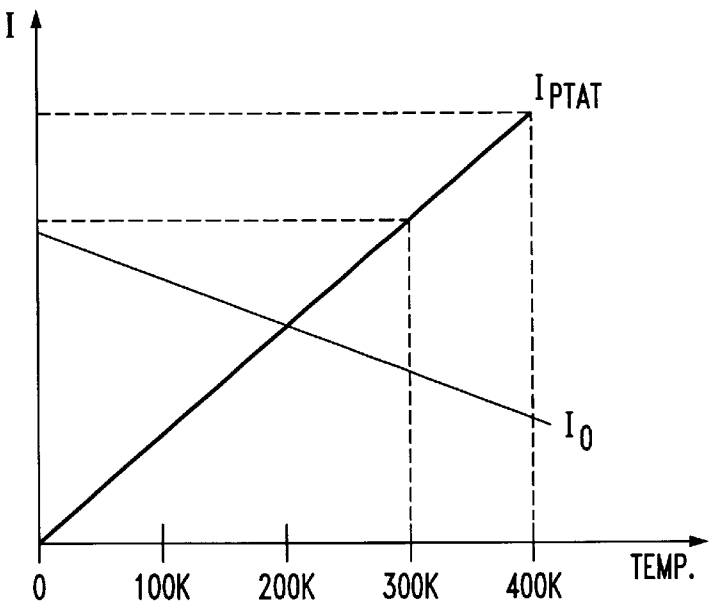
FIG. 3A is a graphical representation illustrating a PTAT current and a negative temperature coefficient current, in accordance with another aspect of the invention.

With reference now to FIGS. 3A and 3B, it can be shown that the constant current $I_0$ which is subtracted from the PTAT current $I_{PTAT}$ is not necessarily required to be independent of temperature to provide an offset PTAT current having a variation which is greater than the absolute temperature variation. Rather, in accordance with another aspect of the invention, as long as the current $I_0$ possesses a temperature coefficient that is zero or less, the resulting offset PTAT current $I_{PTAT}-I_0$ will have a variation that is greater than the absolute temperature variation over a given temperature range.

Specifically, FIG. 3A illustrates a graph of two current components of interest, namely, the PTAT current $I_{PTAT}$ and the constant current $I_0$ superimposed on the same set of axes (e.g., current I versus temperature in degrees K). As shown, the PTAT current possesses a positive temperature coefficient and the constant current possesses a negative temperature coefficient. When the constant current $I_0$ is subtracted from the PTAT current $I_{PTAT}$ an offset current $I_{OPTAT}=I_{PTAT}-I_0$ results, as illustrated in FIG. 3B, which exhibits a larger variation, as compared to when the constant current $I_0$ is independent of temperature (see e.g., FIG. 1B), than the absolute temperature variation.

Figure 4:
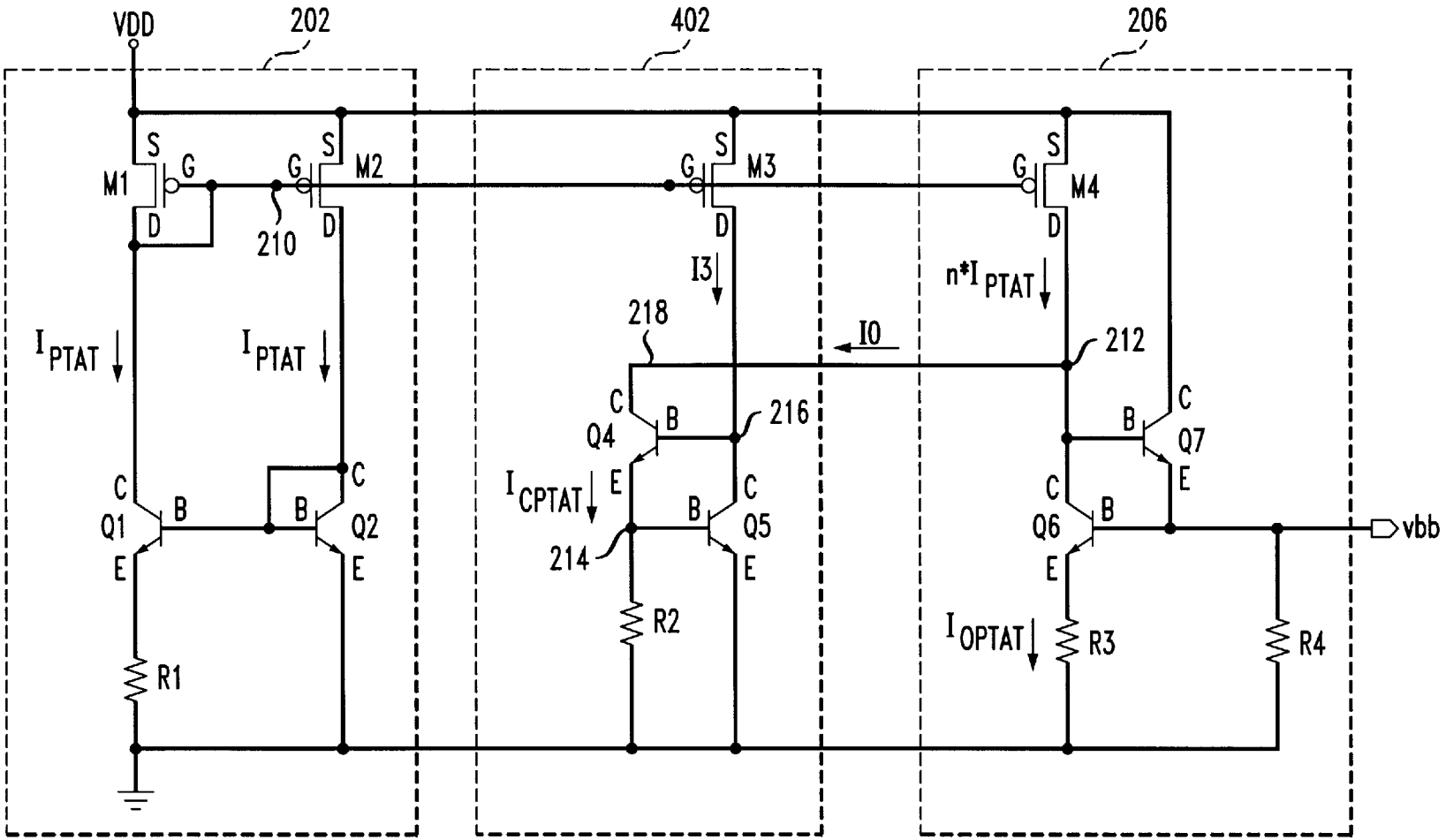
FIG. 4 is a schematic diagram illustrating a temperature-dependent reference source, formed in accordance with another aspect of the present invention.

FIG. 4 depicts an exemplary reference circuit 400 for implementing a temperature-dependent reference having an output which varies greater than the absolute temperature variation, formed in accordance with another aspect of the invention. The illustrative reference circuit 400 includes a PTAT current source 202, a negative temperature coefficient (TC) current source 402 and a subtraction circuit 206 operatively coupled to the PTAT current source 202 and the negative TC current source 402 for generating the temperature-dependent output current $I_{OPTAT}$. It is to be appreciated that the PTAT current source 202 may be implemented in a manner consistent with that described above in connection with FIG. 2 for generating the PTAT current $I_{PTAT}$.

The negative TC current source 402 generates an output current $I_0$ which, unlike the constant current source 204 shown in FIG. 2 (which possesses a substantially zero temperature coefficient), exhibits a complimentary PTAT or negative temperature coefficient. As discussed above, a well known quantity having a predictable negative temperature coefficient is the base-emitter voltage of a typical BJT device. This voltage may be easily converted to a corresponding current by presenting the base-emitter voltage $V_{BE}$ across a resistor. This complementary PTAT current $I_{CPTAT}$ may be generated in a manner consistent with the constant current source 204 described herein above and depicted in FIG. 2.

As previously stated, the base-emitter voltage is preferably generated by BJT transistor Q5 which has an emitter terminal connected to ground. A p-type MOS transistor M3 coupled to transistor M1 in a mirror configuration provides a current I3 for biasing transistor Q5 to a predetermined operating point. Specifically, a source terminal of transistor M3 is connected to the positive supply VDD and a gate terminal of transistor M3 is coupled to the gate terminal of transistor M1 at node 210, whereby the current I3 is a scaled version of the PTAT current generated by the PTAT current source 202, e.g., I3=m·$I_{PTAT}$. The scaling factor m between the current $I_{PTAT}$ and the current I3 will be determined primarily by the W/L ratios of the two transistors M1, M3, respectively (i.e., $$\left(\text{i.e., } m = \frac{(W/L)_{M3}}{(W/L)_{M1}}\right).$$

A drain terminal of transistor M3 is coupled to a collector terminal of transistor Q5 for presenting the mirrored current I3 to transistor Q5.

A resistor R2 connected across the base and emitter terminals of transistor Q5 operatively converts the base-emitter voltage of transistor Q5 ($V_{BE,Q5}$) to a complimentary-PTAT current $I_{CPTAT}$ having a predefined negative temperature coefficient, whereby $I_{CPTAT}=V_{BE,Q5}/R2$ (assuming the base current of transistor Q5 is negligible). This current $I_{CPTAT}$ is preferably passed through a transistor Q4, which has an emitter terminal connected to the junction of the base terminal of transistor Q5 and resistor R2 at node 214 and a base terminal connected to the junction of the collector terminal of transistor Q5 and the drain terminal of transistor M3 at node 216. A collector terminal of transistor Q4 forms an output 218 of the negative TC current source 402. The output current $I_0$ flowing into the output 218 is substantially equal to the current $I_{CPTAT}$, assuming the base current flowing into the base terminal of transistor Q4 is negligible.

It is to be appreciated that since the temperature coefficient of the output current $I_0$ is not required to be zero in this illustrative embodiment of the invention, a positive temperature coefficient current (e.g., $I_{PTAT}$) is not required to be summed with current $I_{CPTAT}$. Therefore, BJT transistor Q3 (see FIG. 2), which formally supplied a weighted PTAT current to be added to the complementary PTAT current $I_{CPTAT}$, has been omitted in the negative TC current source circuit 402.

With continued reference to FIG. 4, the subtraction circuit 206 is preferably implemented in a manner consistent with that previously described in connection with FIG. 2. Specifically, transistor M4 is coupled to transistor M1 in the PTAT current source 202 in a current mirror configuration for supplying a scaled PTAT current n·$I_{PTAT}$. As discussed above, the scale factor n is preferably selected so that the scaled PTAT current n·$I_{PTAT}$ is always larger than the current $I_0$ in at least a desired temperature range of operation. Scale factor n is preferably selected by sizing the W/L ratios of the two transistors M1 and M4, such that $$n = \frac{(W/L)_{M4}}{(W/L)_{M1}}.$$

The output 218 of the negative TC current source 402 is coupled to the drain terminal of transistor M4 to form a subtraction node at 212 whereby the negative TC current $I_0$, which is essentially the current $I_{CPTAT}$, is subtracted from the PTAT current n·$I_{PTAT}$ to generate the offset PTAT current $I_{OPTAT}$ shown in FIG. 3B.

A current sink comprised of BJT transistors Q6 and Q7 and resistors R3 and R4 is operatively coupled to the subtraction node 212 to provide a return path for the current $I_{OPTAT}$, as previously described. Since the PTAT current n·$I_{PTAT}$ flows into subtraction node 212 and current $I_0$, which is less than $n \cdot I_{PTAT}$ in the temperature range of interest, flows out of node 212, the resulting offset current $I_{OPTAT}$ flowing into transistor Q6, and thus through resistor R3, by definition, will be $I_{OPTAT}=n \cdot I_{PTAT}-I_0$, which, as discussed herein above, exhibits a current variation over a given temperature range that is greater than the absolute temperature variation (see e.g., FIG. 3B). Furthermore, compared to the illustrative circuit implementation depicted in FIG. 2, the reference circuit of FIG. 4 consumes less power due, at least in part, to the omission of transistor Q3.

The offset PTAT current $I_{OPTAT}$ can be converted into a voltage vbb at output node 220 which will be the sum of the base-emitter voltage of transistor Q6 and the voltage drop across resistor R3. Thus, output voltage $vbb=V_{BE,Q6}+(I_{OPTAT} \cdot R3)$. This voltage vbb may be used as a reference output preferably by first buffering the voltage. The current $I_{OPTAT}$ may be subsequently mirrored by presenting voltage vbb to a corresponding current source circuit, as will be appreciated by those skilled in the art.

It is to be appreciated that the reference generators described herein may be fabricated on a semiconductor as an integrated circuit device. Using the techniques described herein in accordance with the present invention, circuits having a relatively high temperature dependency can be easily compensated. Moreover, the reference circuits are suitable for temperature sensing with large temperature dependency without requiring a high supply voltage.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A temperature-dependent reference circuit comprising:

a first source, the first source generating an output proportional to absolute temperature (PTAT);

a second source, the second source generating an output having a negative temperature coefficient; and a subtraction circuit coupled to the first and second sources, the subtraction circuit subtracting the output of the second source from the PTAT output and generating an offset output, the offset output having a variation greater than an absolute temperature variation.

2. The reference circuit of claim 1, wherein the first source comprises:

first and second bipolar junction transistors operating at different current densities with respect to each other, each transistor having an emitter terminal, a base terminal and a collector terminal, the base terminals of the transistors being coupled together, the second transistor being connected in a diode arrangement, the emitter terminal of the second transistor being connected to a return supply voltage;

a resistor operatively connected in series between the emitter terminal of the first transistor and the return supply voltage, whereby a difference in base-emitter voltage between the first and second transistors is developed across the resistor, the PTAT output being substantially equal to at least a portion of a current flowing through the resistor; and a current mirror operatively coupled to the collector terminals of the first and second transistors, the current mirror supplying a substantially equal current to each of the transistors.

3. The reference circuit of claim 1, further comprising a bandgap reference, wherein the bandgap reference includes the first and second sources.

4. The reference circuit of claim 1, wherein the output of the first source is a PTAT current.

5. The reference circuit of claim 1, wherein the second source comprises a negative temperature coefficient source for generating a complementary PTAT output having a predefined negative temperature coefficient.

6. The reference circuit of claim 5, wherein the negative temperature coefficient source comprises:

a bias source; and a bipolar junction transistor operatively coupled to the bias source, the bipolar junction transistor generating the negative temperature coefficient output.

7. An integrated circuit including a temperature-dependent reference comprising:

a first source, the first source generating a proportional to absolute temperature (PTAT) output;

a second source, the second source generating an output having a negative temperature coefficient; and a subtraction circuit coupled to the first and second sources, the subtraction circuit subtracting the output of the second source from the PTAT output and generating an offset output, the offset output having a variation greater than an absolute temperature variation.

8. The integrated circuit of claim 7, wherein the first source comprises:

first and second bipolar junction transistors operating at different current densities with respect to each other, each transistor having an emitter terminal, a base terminal and a collector terminal, the base terminals of the transistors being coupled together, the second transistor being connected in a diode arrangement, the emitter terminal of the second transistor being connected to a return supply voltage;

a resistor operatively connected in series between the emitter terminal of the first transistor and the return supply voltage, whereby a difference in base-emitter voltage between the first and second transistors is developed across the resistor, the PTAT output being substantially equal to at least a portion of a current flowing through the resistor; and a current mirror operatively coupled to the collector terminals of the first and second transistors, the current mirror supplying a substantially equal current to each of the transistors.

9. The integrated circuit of claim 7, wherein the second source comprises a negative temperature coefficient source for generating a complementary PTAT output having a predefined negative temperature coefficient.

10. The integrated circuit of claim 7, further comprising a bandgap reference, wherein the bandgap reference includes the first and second sources.

11. The integrated circuit of claim 7, wherein the output of the first source is a PTAT current.

12. A method of generating a temperature-dependent reference output having a variation greater than an absolute temperature variation, the method comprising the steps of:

generating a first output, the first output having a variation that is proportional to absolute temperature (PTAT);

generating a second output, the second output having a negative temperature coefficient;

subtracting the second output from the first output to generate the temperature-dependent reference output having a variation greater than an absolute temperature variation.

13. The method of claim 12, wherein the step of generating the first output comprises the step of:

providing a pair of bipolar junction transistors, each of the transistors having an emitter terminal, a base terminal and a collector terminal, the pair of transistors being operatively coupled together and biased so that one of the transistors operates at a higher current density than the other transistor, whereby a difference in a base-emitter voltage of the two transistors is developed, the base-emitter voltage difference having a PTAT variation, the first output corresponding to at least a portion of the base-emitter voltage difference.

* * * * *